United States Patent [19]

Zimmer

[11] Patent Number: 4,920,914

[45] Date of Patent: May 1, 1990

[54] DOCTORING INSTALLATION AND DOCTORING DEVICE

[76] Inventor: Johannes Zimmer, Ebentaler Strasse 133, 9020 Klagenfurt, Austria

[21] Appl. No.: 255,604

[22] Filed: Oct. 11, 1988

[30] Foreign Application Priority Data

| | | | |
|---|---|---|---|
| Oct. 10, 1987 | [EP] | European Pat. Off. | 87730126 |
| Oct. 10, 1987 | [EP] | European Pat. Off. | 87730128 |
| Oct. 10, 1987 | [DE] | Fed. Rep. of Germany | 3734747 |
| Oct. 10, 1987 | [DE] | Fed. Rep. of Germany | 8713788 |
| Oct. 10, 1987 | [DE] | Fed. Rep. of Germany | 8713789 |

[51] Int. Cl.[5] ..... B05C 1/06

[52] U.S. Cl. ..... 118/419; 101/120

[58] Field of Search ..... 118/100, 112, 118, 119, 118/126, 213, 262, 413, 406, 414, 110, 123, 407, 410, 419, DIG. 14; 101/119, 120

[56] References Cited

U.S. PATENT DOCUMENTS

| | | | |
|---|---|---|---|
| 2,546,342 | 3/1951 | Jurgensen et al. | 118/126 |
| 3,070,461 | 12/1962 | Beachler | 118/413 |
| 3,255,038 | 6/1966 | Coghill | 118/126 |
| 3,282,244 | 11/1966 | Hill et al. | 118/126 |
| 3,450,098 | 6/1969 | Williams | 118/126 |
| 3,613,635 | 3/1969 | Brehm | 118/406 |
| 3,683,851 | 8/1972 | Nolden | 118/126 |
| 3,901,146 | 8/1975 | Stierlein | 101/119 |
| 3,919,973 | 11/1975 | Zimmer | 118/406 |
| 4,036,129 | 7/1977 | Zimmer | 101/120 |

FOREIGN PATENT DOCUMENTS 8002400 11/1980 World Int. Prop. O. .

*Primary Examiner*—Willard Hoag

*Attorney, Agent, or Firm*—Fay, Sharpe, Beall, Fagan, Minnich & McKee

[57] ABSTRACT

The doctor device has a profile member pivotally mounted to a retaining member that is carried on a mount. Vertical movement of the mount causes angular displacement of the profile member thereby changing the material application area disposed adjacent and upstream of the doctor. The doctor is either a doctor blade or roll doctor. In the case of a roll doctor, a receptacle is formed in the profile member and the roll doctor is magnetically retained within the receptacle. During application of a material to an application surface with the roll doctor, the roll doctor is magnetically attracted to the application surface by a second magnetic device located beneath the application surface or work surface.

36 Claims, 7 Drawing Sheets

DOCTORING INSTALLATION AND DOCTORING DEVICE

BACKGROUND OF THE INVENTION

1. Field of the Invention

The invention relates to a doctor device for applying material, such as optionally foamable substances of varying viscosity, coating substances, lacquers, adhesives, pastes, etc. to an application surface (substrate) with the doctor pressable onto the latter. Such devices are used e.g. in flat screen printing, circular screen applications and/or apparatuses for screen-free, full-surface applications, in which the width of the application surface or the extension of the doctor can be several meters. As a function of the machine type, it is possible to carry out patterning applications (printing) and/or full-surface applications (e.g. impregnation, coating, dyeing, lacquering).

2. Description of the Related Art

Considerable significance is attached to the control of the application and the setting of the application quantities. In addition, the operating and use possibilities of a machine are dependent on the doctors used. The term "doctor" is generally understood to mean a coating profile with having varied constructions. The term includes blade coating doctors, circular profile coating doctors and roll doctors.

It is known to vary the application method by modifying the angular position of the doctor device, the contact pressure and/or the type of doctor device. The result of the application is dependent on the contact pressure, the substrate material, the application material viscosity and/or the size or spatial form of the application material supplied upstream of the doctor, as well as the fitting, construction and structural size of the apparatus. The constructional, control, dimensional and operational problems encountered with these type of apparatus have not been satisfactorily solved in all respects.

Devices operating exclusively with doctor rolls are known (DE-OS No. 25 44 784), in which a doctor roll can be pressed against the back of a separately arranged profile strip spaced from the rolling surface of the roll. It is disadvantageous in this arrangement that several independant components are required, which are for influencing the application result, and that a special machine type must be kept available in an adapted manner and can only be fitted, removed and cleaned separately from one another. Another known doctor device for exclusive use with a blade coating doctor (DE-OS No. 2 207 935) comprises a relatively solid and bulky doctor device with a rod holding the blade coating doctor and which is fixed to a support pipe. A relatively large-area lever apparatus comprising several guide and support arms is provided for modifying the angular position of the doctor device by means of a mechanical forced control. A doctor means known from WO-A-8 002 400 comprises an auxilliary mechanism with a substantially U-shaped profile having an accumulation surface for guiding magnetically pressable doctor rolls. It is proposed that the U-shaped profile be adjustably mounted in a spaced, angular manner with respect to a magnetic device positioned below an application surface. However, no specific measures for mounting the U-shaped profiles are disclosed. The only pivoting movement considered possible is about the axis of a doctor roll. For this purpose and for the purpose of vertically modifying the position of the U-shaped profile, consideration can only be given to providing a forced control for the profile as a function of the machine type used. In the case of a forced control of the type known from DE-OS No. 2 207 935, it is not possible or is only possible with considerable mechanical expenditure to achieve a desired, reproducible fine adjustment of an application result.

SUMMARY OF THE INVENTION

An important object of the invention is to provide a doctor means and a doctor device, which have a simple construction, are compact, are easy to handle and universally usable in different application machines. The application result or substance application, must be variable in a fine-acting, continuous, precise, reproducible and clearly defined manner during the operation of a machine without replacing parts.

According to the invention a means for the application of material, such as optionally foamable substances of varying viscosity, coating substances, lacquers, adhesives, pastes, etc. to an application surface (substrate) comprises a doctor device, with which is associated a doctor, and a mount. The doctor device comprises a profile member guiding the doctor and a retaining member in the form of a retaining strip, retaining profile, etc. One end of the retaining member is carried by the mount and the profile member is spaced from the retaining member by the mount and is freely pivotably connected with the other end of the retaining member by means of a joint about a longitudinal axis defined by the extension of the doctor in such a way that the pivoting of the profile member is brought about as a consequence of a change to the spacing between the mount and the application surface.

According to a further embodiment of the invention the doctor device comprises a profile member, which has at least one profile surface facing the application surface and extending parallel to the longitudinal axis of a the doctor. The device further includes a retaining member in the form of a retaining strip, retaining profile, etc., one end of which is carried by the mount and the other end of which supports the profile member so that by varying the height of the part of the profile member having the profile surface, it is possible to modify an accumulation area for the application material upstream of a roll or circular profile coating doctor.

According to another embodiment of the invention the doctor device has a profile member, which has at least one profile surface facing the application surface and extending parallel to the longitudinal axis of the doctor and a retaining member in the form of a retaining strip. The doctor further includes a retaining profile or the like, one end of the retaining member being carried by the mount wherein the profile member is spaced from the mount by the retaining member and is fixed to the other end of the retaining member and wherein the mount is arranged and guided in a pivotable manner about the longitudinal axis of the doctor in such a way that the profile member engages the doctor within a circumferential range of approximately 25° to 75° on the side facing the application material and measured from the doctor pressing line so that the profile member with the mount is so relatively pivotable over the retaining member that through the pivoting the shape and size of a substance area formed between the profile surface and the application surface is variable.

The invention also relates to a doctor device for the application of material, such as optionally foamable substances of varying viscosity, coating substances, lacquers, adhesives, pastes, etc. to an application surface (substrate) with a magnetically pressable doctor associated with the doctor device, the latter being constructed as an independently fittable profile member, provided with a swivel or pivot joint and guiding the doctor in the form of a blade coating doctor, circular profile coating doctor and/or roll doctor, with at least one doctor or profile surface parallel to the longitudinal axis of one of the doctor. By means of the pivot joint the doctor device can be used in the manner of a modular component with various doctor means or application machines, preferably being connected by a simple plug so that the doctor device is freely pivotable without a mechanical forced control.

The conversion of the spacing movement of the mount into the pivoting movement of the profile member permits a very effective and precisely realizable positioning of the profile member with respect to the parameters decisive for an application material (substance) application. The pivoting movement of the profile member permits a variation, in any desired manner, of the substance accumulation space between the profile member and the application surface or screen, with respect to size or shape and/or an application angle of a substance wedge, which is located in the doctor extension upstream of a doctor or its application or pressing line. The free pivotability of the profile member by means of the joint arranged thereon is performable within a wide angular range with small spacing variations of the mount. The spacing variation of the mount with respect to the application surface can be realized with simple means, and, according to an important aspect of the invention, can be performed during the machine operation. Another important advantage is that the same profile member can be used for different applications results, different application types and/or different machines, because as regards its application action it can be adjusted to different desired application functions due to the pivoting which can be performed in a wide angular range. The profile member can hold or guide a blade coating doctor, a circular profile rod coating doctor and/or a roll doctor. With regards to the application result, the level of the contact pressure of the profile member towards the application surface is less important than with the conventional means, because as a result of the pivotability of the profile member the application result can be adjusted to a considerable extent independently of a large or small contact pressure. The retaining member connecting the profile member to the mount extends in the vicinity of an imaginary surface, which is at right angles to the application surface and located in the doctor pressing line. Thus, the doctor device with the profile member, the retaining member and a connecting element of the mount, e.g. an ink supply tube for cross beam fixed to the retaining member, is very compact.

The application result can be favourably influenced by at least one longitudinally axially parallel doctor or profile surface of the profile member facing the application surface. The doctor/profile surface forms a working gap and/or application material area tapering in a wedge-shaped manner substantially in the direction of a doctor pressing line. The working gap or application material area can be modified to a significant extent during machine operation. It is appropriate for certain applications that the doctor device profile surface forms a flat working gap, whereas in other cases a steep working gap formed with the said profile surface is advantageous. In the case of a flat working gap or a flat substance wedge a relatively large dynamic pressure is exerted on the substance, so that there is a correspondingly large penetration depth into a substrate. A steep working gap leads to a relatively large substance area and in such a case there is a relatively limited dynamic pressure on the substance. A flat or steep working gap can be modifed continuously and, if desired, only slightly by a pivoting movement of the doctor element. It can also be appropriate to position a relatively steep working gap upstream of a flat working gap, the profile element having two oriented profile surfaces passing into one another.

The profile element can be constructed as a coating doctor and/or a roll doctor. It is advantageous if the profile element is constructed as a one-piece or integral profile strip, in which a doctor is preferably mounted by means of a receptacle. In order to obtain a very marked mobility or elasticity of a coating doctor blade, a coating doctor is mounted so as to move aside in a direction remote from the application surface, the profile strip being cut free on the side remote from the application surface in such a way that a recess is formed on the back of the doctor.

According to an advantageous embodiment of the invention the profile member is constructed in an integrated manner with a roll doctor, which is located in a free-running manner in a receptacle of the profile member. The profile member can be held in tiltable or pivotable manner about an extension axis of the doctor roll. A web sliding surface of a slot-shaped, axially parallel receptacle can tilt about its apex area engaging on the doctor roll. This engagement acts advantageously in the manner of a sealing strip, so that no substance can pass into the area behind the doctor roll.

A magnetizable roll doctor can be rotatably mounted against the sliding surface or coating by the force of a magnetic device arranged in the profile member and which preferably has permanent holding magnets. It is advantageous for the magnetic device to be constructed as a support element along the profile member longitudinal axis. A further appropriate combination measure is that the support member preferably formed with permanent magnets comprises a magnetizable material, so that the support member, as well as the roll doctor is magnetically attractable for roll pressing by means of a magnetic device arranged under the application surface. This leads to a number of very important advantages. In particular, the profile member and doctor roll form a very practical handling unit, which can be fitted jointly in a printing means, in particular in the relatively confined space within a circular screen and in the same way can be removed therefrom and cleaned as a unit.

The permanent magnet roll doctor mount is appropriately suitable for receiving a small diameter, considerable length roll, because on handling said roll alone there would be a considerable bending or distortion risk. The weight of the profile member, together with that of the support member advantageously forms a counterweight on the accumulation area formed in operation upstream of the roll doctor. This effect is reinforced by the magnetic force of a magnetic device arranged under the application surface. If necessary, the magnetic device can be counteracted by the structural weight of the profile strip and the force resulting from the support member weight by a corresponding opposing production of magnetic force. Through the magnetic force of the magnetic device varying during operation below the application surface the counterpressure can be adapted, which is brought about by the profile member with its accumulation surface and which acts against that of the substance accumulation pressure. This is in turn dependent on the width of the accumulation surface, the substance viscosity and the machine operating speed.

A preferably rod-like permanent magnet extending over the doctor has a double function. When the machine is switched off, due to its permanent magnetic force, it acts as a roll doctor retaining rod or beam, whereas when the machine is operating it is used for magnetic doctor pressing. The (permanent) magnet roll doctor mount allows the doctor device to be operated with roll doctors of relatively small diameter. However, due to the functional unit constructed with the profile member it is possible to use the same for applying a large substance quantity. The universal use possibility of a relatively thin roll doctor is also achieved in that, if necessary, a reinforcing of the magnetic attraction-pressing force of the support member or profile member, which rests on the roll doctor, is brought about. The advantageous construction of the profile strip with an integrated roll doctor of relatively small diameter is not restricted to a construction of the profile member with a (permanent) magnet.

In the case of a profile member provided for a roll doctor, it can be appropriately achieved that the roll doctor engages on a lateral flank of an inparticular slot-like receptacle. This leads to sealing against the passage of application substance along the doctor. It is advantageous for the roll doctor to be movably mounted in the receptacle at right angles to its extension, so that, as desired, a sealing engagement on one of the (slot) reception flanks can be achieved.

The distance between the mount and the application surface can be varied by an adjustment substantially perpendicular thereto, by pivoting the mount and/or by guiding the latter along a curved path. A perpendicular adjustment is advantageously obtained in that the mount comprises supports, which, laterally of the application surface are arranged variably with respect to its height position and which mount the profile member. The mount is advantageously pivoted about an axis parallel to the doctor longitudinal axis, which is located on the side of the application surface with respect to the mount. Thus, on lowering the mount or reducing the spacing, a doctor pressing line can be moved up either against or in the running direction of a substrate path. For moving the profile member or a doctor pressing line at right angles to the substrate running direction it is also possible to provide a link guide of the mount along a curved path, with which the mount is transversely movable and also raisable and lowerable. A further construction comprises positioning the mount which is continuously adjustable to different spacings with respect to the application line so as to be positionally variable at right angles to the doctor extension substantially parallel to the application surface. It can be appropriate to combine and jointly carry out at least some of the movements of the mount in various coordinate directions.

The pivoting longitudinal axis of the profile member joint can be displaced via the centre of gravity or the longitudinal axis centre of gravity line of the profile member in such a way that it can be pivoted to the right or left under the action of its own weight.

To articulate the profile member to the left or right by means of the pivot joint and/or to preset a pivoting amount, it is appropriate to provide several joint connecting members on the profile member, which are differently displaced with respect to the centre of gravity line and can be used as desired. Preferably a joint connecting member is constructed in the form of a plug or clamp member. Such a joint member can be rapidly detachably connected to the retaining member. A material-elastic pivot joint can be constructed on a plastic profile member.

It is desirable for certain applications that a doctor pressing line is displaced in or counter to the running direction of the substrate path, as a function of the angular position of the profile member and this can be readily realized with the invention. However, a continuously fixed retaining of a doctor pressing line can be appropriate. This is achieved in that in the case of a profile member pivoting to the right there is a suitable movement of the mount at right angles to the doctor extension in the running direction of the substrate path. On pivoting the profile member to the left, the mount is arranged in such a way that it is adequately displaced against the substrate running direction.

According to an embodiment of the invention a swivel or pivot joint is arranged on a swivel or pivot arm of the profile member, so that the profile member is kept at a specific distance from the application surface or a screen. On equipping the profile member with a roll doctor, it is appropriate to construct the profile member with a magnetically held doctor roll, as described hereinbefore. In the operating state of a printing apparatus operating with such a roll doctor device, as a result of the profile element spacing with respect to the application surface/screen, the roll doctor can be torn away from the profile member permanent magnet, so that it no longer has any contact with a web surface of a slot-like, particularly rectangular receptacle. When the printing apparatus is not operating, the roll doctor, as a result of the attracting force of the permanent magnet, springs into a position engaging on the receptacle web surface, in which it is spaced from an application surface or screen. The functional or handling unit comprising profile member and roll doctor can be very easily removed from the printing apparatus or inserted therein.

The accumulation or profile surfaces of the profile member can, as a function of the desired use, be planar or suitably curved for special influencing of the substance accumulation.

BRIEF DESCRIPTION OF THE DRAWINGS

Further advantages, developments and embodiment of the invention can be gathered from the following description relative to the drawings shown in side view and sectional representation, wherein.

DESCRIPTION OF THE PREFERRED EMBODIMENTS

Figure 1:
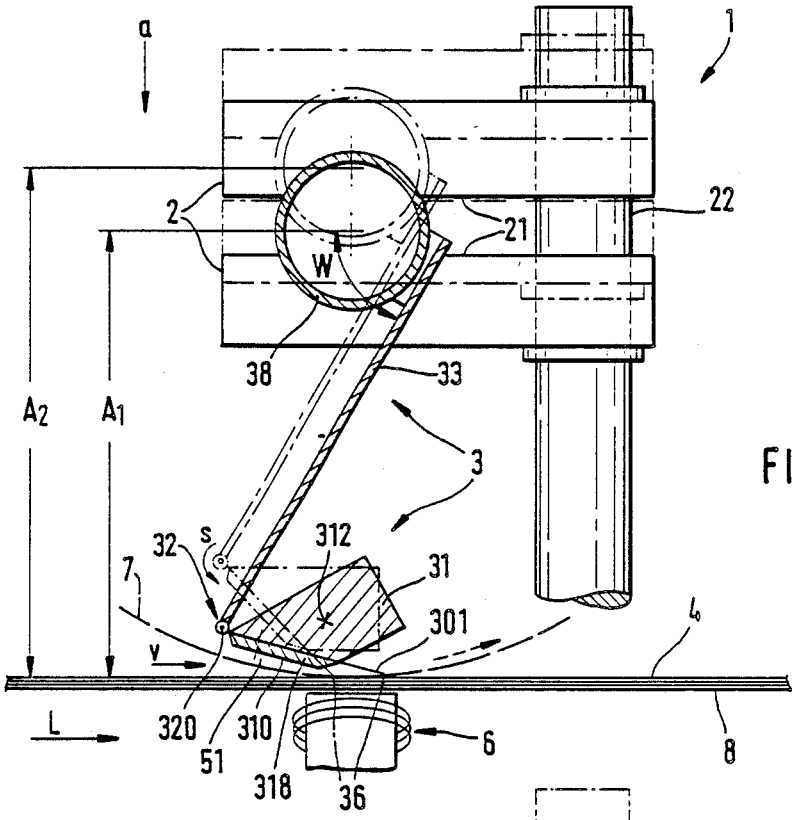
FIG. 1 is a plan view, partly in section, of an apparatus according to the invention with a magnetic coating device.

FIGS. 1 to 20 in each case show a doctor device 3 in a machine for a circular screen application. Each doctor device 3 extends in a circular screen 7. Between the latter and a printing blanket 8 is located a material web forming the substrate for an application surface. During printing, the substrate is moved by the printing blanket 8 in direction L; and through the pressing of a doctor 301, 302, 303, 304 against the screen 7 is has printed thereon a pattern with a substance 5 located upstream of a doctor pressing line 36 in movement direction L.

Each doctor device 3 comprises a profile member 31, 30, 300 mounting a doctor 301, 302, 303, 304, a retaining member 33 and a crossbeam 38, which appropriately forms a substance supply pipe or that alternatively carries the same in its interior. Retaining member 33 is, with the exception of the embodiment of FIG. 14, fixed under an angle W to the crossbeam 38, e.g. by a screw or welded connection.

According to FIGS. 1 to 15 the profile member 21 is articulated on the retaining member 33 so as to be freely pivotable by means of joint 32 in the area over application surface 4 about a longitudinal axis 320 defined by the extension of a doctor 301, 302. The retaining member in the form of a retaining strip, retaining profile, etc. is preferably shaped in such a way and is so connected to the crossbeam 38, that the profile member 31 is substantially located below said crossbeam 38, the doctor line 36 being located in the vicinity of the vertical line of the axially parallel plane of symmetry of the crossbeam 38, perpendicular to the material web 4. Profile member 31 is pivotable by varying the spacing A of a mount 2 with respect to the application surface 4.

Figure 2:
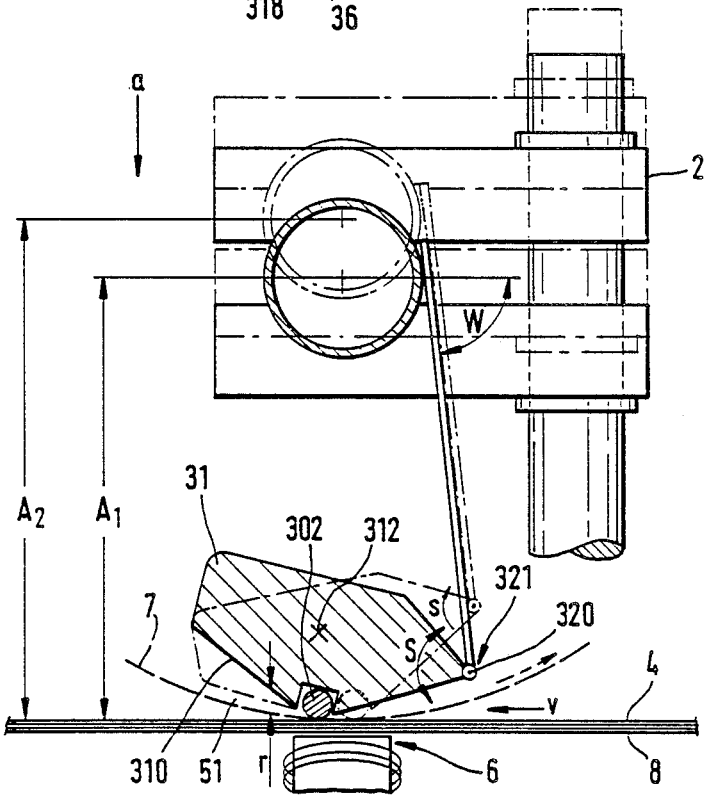
FIG. 2 is a plan view partly in section, of a device according to the invention with a magnetic roll doctor.

According to FIGS. 1 and 2 a mount 2 comprises mounting supports 21 constructed as bearing rests, in which is placed a crossbeam 38. The mounting supports 21 are positioned laterally of material web 4 in an application apparatus not shown, so that the crossbeam 38 extends freely over the application surface 4 or material width. The mounting supports 21 are continuously and in particular electromotively vertically adjustable by means of a stand guide 22.

In FIGS. 1 to 15 the profile member 31 is constructed as a profile strip extending parallel to the joint axis 320. It is made at least partly from a magnetizable material or, along its extension, is embedded in a magnetizable support element in the form of a support 35, as shown in FIGS. 6 to 11.

Therefore the profile strip 31 is magnetically attractable along its extension in a uniform manner towards the printing blanket 8 by means of a magnetic device 6 arranged below it. A special measure consists of mounting a doctor 301, 302 in the profile strip. Thus, FIGS. 1 and 7 to 9 show a coating doctor 301, which is mounted in the lower area of the profile strip facing the application surface 4. On the underside of each profile strip 31 is formed a longitudinally axially parallel doctor or profile surface 310 facing the application surface 4 and which has a working gap r tapering in a wedge-shaped manner in the direction of the doctor pressing line 36 and therefore forming an application material area 51.

According to the embodiments of FIGS. 2 to 6 and 11 to 15 the profile strip 31 is designed in combination with a roll doctor 302. The roll doctor 302 is guided in free running manner in a longitudinally axially parallel, slot-like receptacle, which is open towards the material web 4 and allows doctor 302 to roll on the screen 7 or relative to the material web 4. The walls of receptacle 314 are constructed as sliding surfaces 315 or provided with a suitable sliding coating.

Figure 3:
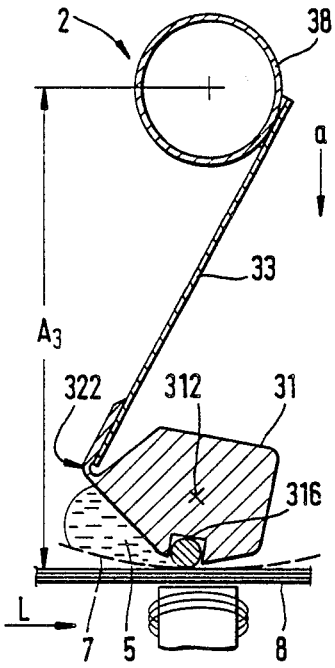
FIGS. 3 to 5 are views similar to FIGS. 1 and 2 of the device according to the invention with different pivoting articulations of a profile member being shown.
Figure 4:
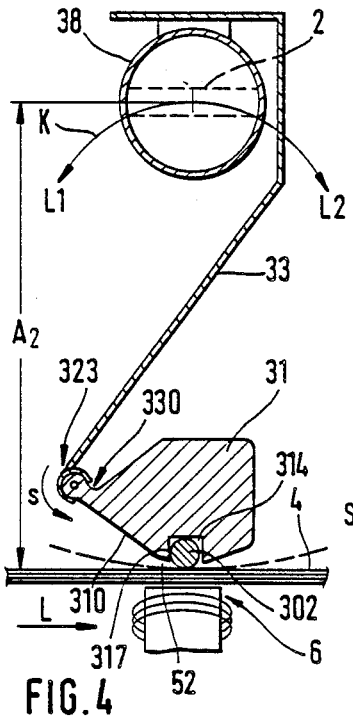
Figure 5:
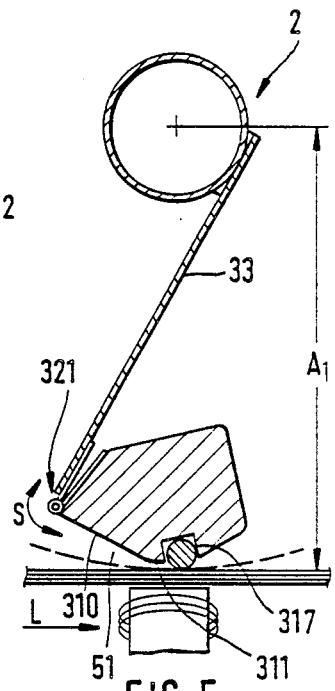

According to FIGS. 2 to 6 and 12 to 15, the profile strip 31 is located in the vertical area of the doctor roll 302 along a longitudinally axially extending parallel line 316, so to engage or be pressed against doctor 302. In the vicinity of the doctor roll vertical area the profile strip 31 tilts or pivots about an axis 316 in said area. It is important that the profile strip 31 resting on the doctor roll 302 has a sealing function and acts as a sealing strip with which the substance in the space 51 is sealed with respect to the area located behind the roll doctor in movement direction L. The roll doctor 302 can also engage on a lateral wall 319 of the slot-like receptacle 314 along a line 317. These two possibilities are shown in FIGS. 4 and 5, which leads to an additional sealing with respect to the vertical area 316.

Figure 6:
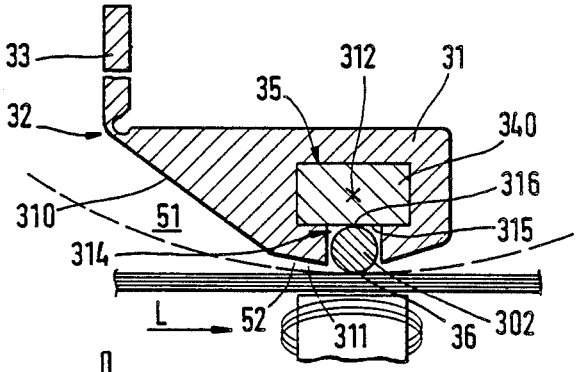
FIG. 6 is a sectional view of a profile member with a magnetizable support member including a permanent magnetically mounted roll doctor.

FIG. 6 shows an advantageous magnetic mounting support of the roll doctor 302 by means of a longitudinally axially parallel and in particular beam-like permanent magnet 340 embedded in profile strip 31. During fitting and removal, the profile strip 31 can consequently be handled as a unitary, quasi-one-part component together with the doctor 302. The latter is made from a magnetizable material and is held in the receptacle against the sliding surface 315 by means of the magnetic device 340 comprising several holding magnets. The sliding surface spatially separates the doctor roll from magnets 340. The permanent magnets 340 positioned above the doctor have a double function. Outside the machine operating state, as a result of the permanent magnetic force thereof, they act as doctor roll retaining rods or beams, whereas when the machine is operating they serve as a magnetizable material attractable by the magnetic device 6 for profile strip or doctor pressing.

The profile strips 31 shown in FIGS. 3 to 11, apart from the aforementioned profile surface 310, have a profile surface 311 facing the application surface 4 and extending in the longitudinal direction of the doctor and which is arranged between the profile surface 310 and doctor 301 or 302. Directly upstream of doctor 301 or 302, it forms a relatively flat, short working gap, with a relatively steep substance area 51 formed with the profile surface 310. Through the combination of the two profile surfaces 310, 311, immediately upstream of doctor 301 or 302, the profile strip 31 exercises by means of a gap r or accumulation area 52 the actual substance application function, while the size and shape of the substance upstream of doctor 301 or 302 are substantially adjustable by varying the wedge-shaped accumulation area 51. In general, a flat working gap directly on the blade of the coating doctor 301 or upstream of the doctor roll 302 ensures that this essentially leads to the application function of doctor element 31. Doctor 301 or 302 provides a sealing against the substance along doctor line 36 and scrapes the screen 7 clean. A combination of one or more profile strip surfaces with a doctor roll 302 mounted in the profile strip, whilst controlling the pivoting position of profile strip 31 and therefore while controlling the setting angle of the profile surfaces, is very effectively achieved in that the application action is adjustable in a fine-working manner from a mainly roll doctor action to a coating doctor action or conversely, particularly during machine operation.

FIGS. 1 and 2 show how even a limited vertical positional variation of mount 2 leads to a significant variation in the shape and/or size of the accumulation area 51 upstream of the doctor pressing line 36. From the dotted line position with spacing A2, the mount 2 is lowered in the vertical direction A to application surface 4 on height A1. In FIG. 1 joint 32 is arranged on the side of the accumulation area 51 of profile member 31, so that there is a pivoting movement to the left in direction s in the case of reducing the spacing. However, according to FIG. 2, on lowering the mount 2, there is a pivoting movement S to the right in direction s. Thus, as required, by varying the spacing in direction s, the substance area 51 or a profile surface inclination angle with the material web 4 can be increased or decreased.

FIGS. 3 to 4 show how the angular positions of the profile member 31 are varied as a result of different spacings A1, A2, A3 of mount 2 relative to the application surface 4.

In the embodiments according to FIGS. 1 and 2 the doctor pressing line is displaced along the material web running direction L in the case of a pivoting movement s to the left. Correspondingly there is a displacement v counter to the web running direction L in the case of a pivoting s to the right. Thus, through modifying the spacing A there is a planned change to the position of the contact line 36 along the material web 4 or along the screen 7. This is particularly important if the application line of the screen to the material web 4 changes during machine operation, a doctor changes position during the operation and/or the doctor pressing line is to be varied for different substance dynamic pressures.

In an embodiment according to FIG. 4 the modification of the spacing A2 of mount 2 with respect to application surface 4 is combined with a horizontal movement component of mount 2. Mount 2, which carries the crossbeam 38, is pivoted along an arc or curve K and/or is guided on a curve, e.g. with links. On lowering mount 2 in direction L1, joint 323 is displaced against the material web running direction L. However, as the doctor pressing line 36 is moved in the material web running direction L due to the pivoting movement in direction s of profile strip 31, the two opposite movements can be balanced out, so that the roll doctor 32, as a function of a suitably chosen curvature of curve K, can be held in a planned manner in its central position over magnetic device 6. On lowering the mount in direction L2, the displacement of the pressing line obtained through the pivoting movement is increased in the material running direction L. A planned displacement to the left or right can also determine on which flank of receptacle 314 the roll doctor 302 is to engage. In the embodiment according to FIG. 4 the retaining member 33 is fixed to the vertical line of crossbeam 38.

FIGS. 5 and 7 to 9 realize the pivotal mounting support of profile member 31 on retaining member 33 by means of a hinge 321. According to FIGS. 3 and 6 a material-elastic joint is provided, while in FIG. 4 there is a clamping-plug connection 323. A connecting element 330 is detachably inserted in a clamp shell of retaining member 33. Connecting elements 330 can advantageously also be arranged on other parts of the profile member, in order to carry out their pivoting articulation, as required.

Figure 7:
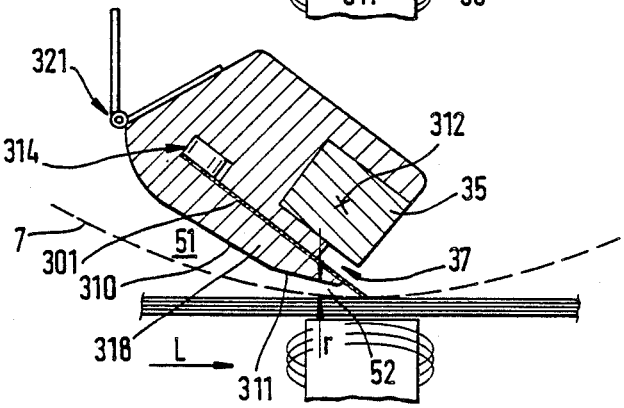
FIG. 7 is a sectional view of a profile member with a coating doctor and a magnetizable support member.
Figure 8:
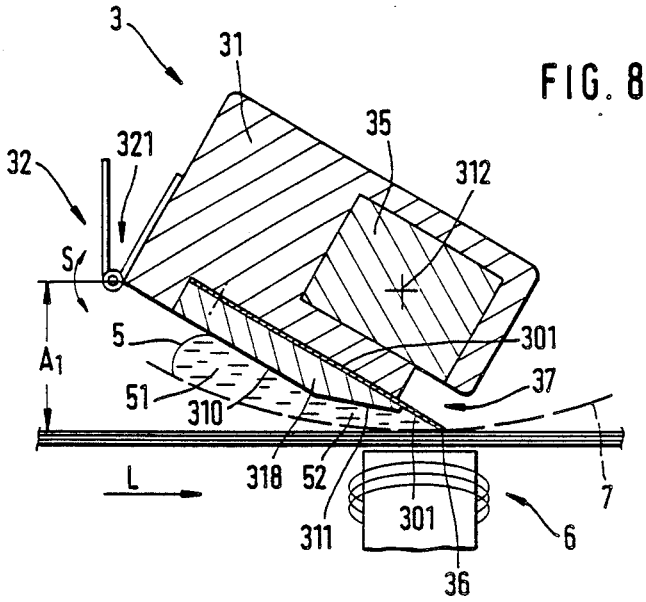
FIGS. 8 and 9 are plan views, partly in section, of doctor devices according to the invention each having an integrated coating device and magnetizable a support member.
Figure 9:
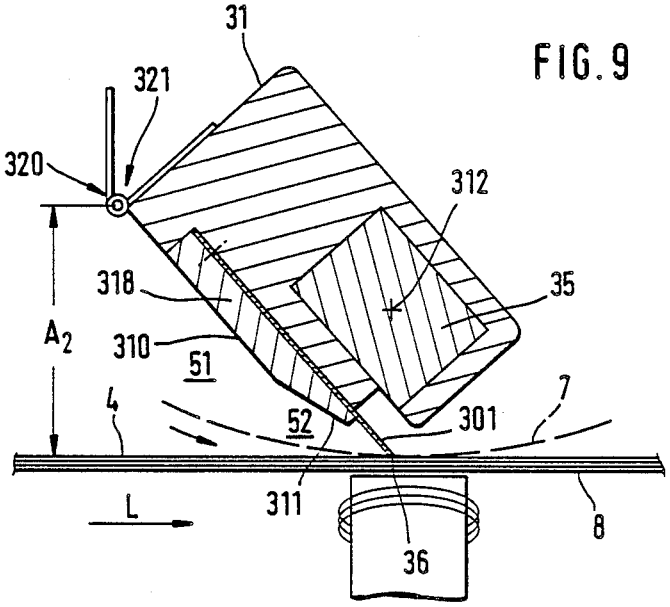

According to FIG. 7, in connection with a very advantageous mobility or elasticity of the blade, in the vicinity of the back of the doctor a recess 37 is formed in the profile member. Such recesses are shown in FIGS. 8 and 9. In order to concentrate the action of the coating doctor 301 on its blade, it is appropriate to cover it with a profile surface part 318 of the profile member, as shown in FIGS. 7 to 9.

FIGS. 8 and 9 show a profile member 31, in which is mounted or held a coating doctor 301 in the lower area facing the application surface 4 by means of a profile bearing plate 318 integrated into profile member 31. By means of a beam-like support member 35 with a rectangular cross-section and with a magnetizable material, embedded in profile member 31 and extending in the doctor direction and which is arranged above said doctor 301 in the vicinity of its free end, the doctor is pressed along line 36 against the screen 7 or the application surface 4. In the vicinity of the back of the doctor strip, i.e. above line 36, on profile strip 31 is formed a recess 37. The profile bearing plate 310 extends by a small amount into the vicinity of the recess.

Figure 10:
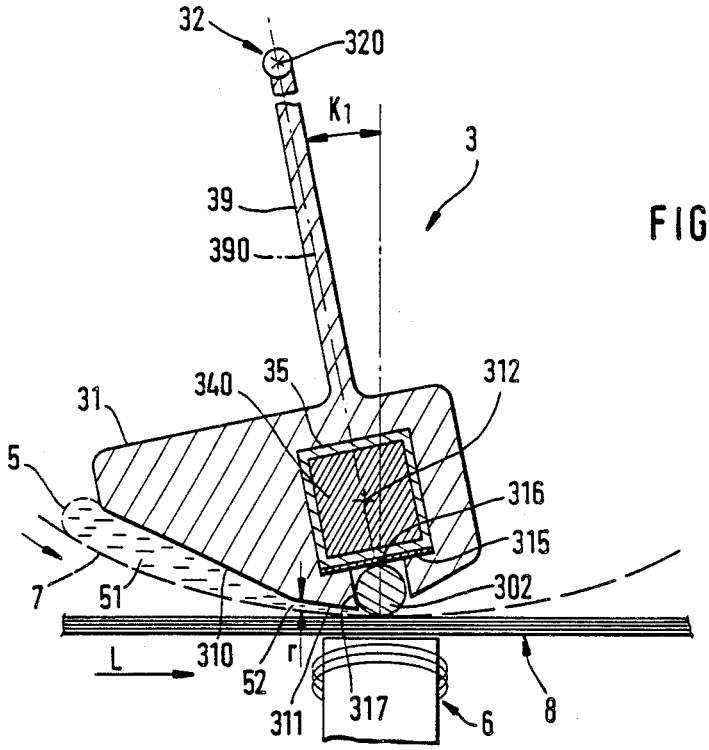
FIGS. 10 and 11 are plan views, partly in section, of doctor devices according to the invention with permanent magnetically carried roll doctor.
Figure 11:
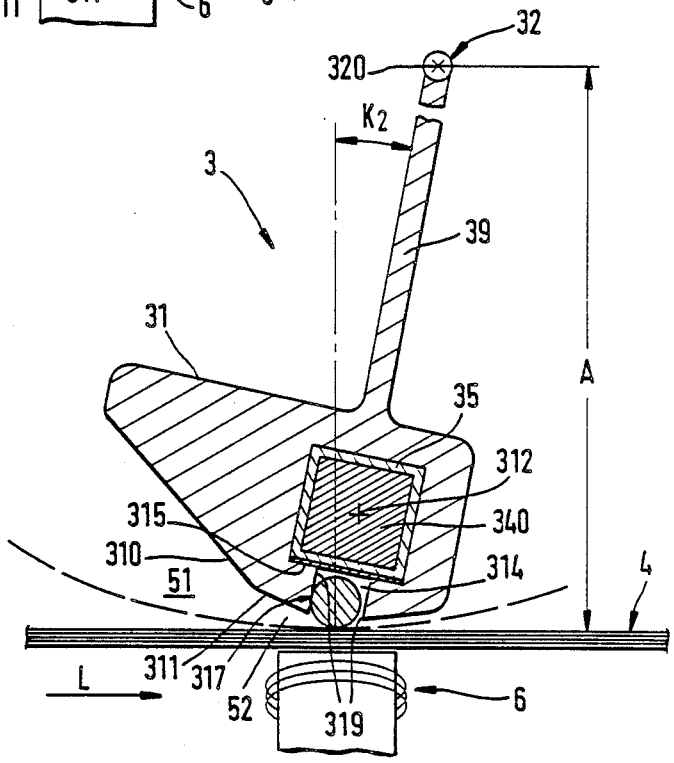

In FIGS. 10 and 11 a profile member 31, which is made partly from plastic, is constructed as a profile strip extending parallel to a longitudinal or joint axis 320 defined by the doctor extension, along its extension a magnetizable support member 35 of rectangular cross-section in the form of a support is embedded in the profile member plastic part. The support member 35 in snuggly engaging manner surrounds a permanent magnetic support member part 340 located along the doctor extension. On the side of the support member 35 facing the application surface 4 is arranged a non-magnetizable sliding surface 315, which forms the web part of a slot-shaped, longitudinally axially parallel receptacle 314 having a rectangular cross-section, which is open towards application surface 4 and provides a support for a roll doctor 302. The flank walls also carry a sliding coating. Thus, the roll doctor is guided in free running manner in receptacle 314.

Along its extension the profile strip 31 with the support member 35, 340 is uniformly magnetically attractable in the direction of the printing blanket 8 by means of a magnetic device 6 arranged below the same.

Each profile strip 31 according to FIGS. 10 and 11 comprises a pivot arm profile 39, whose arm axis 390 pivotable about the joint axis 320 is perpendicular to the support member longitudinal axis 312. Each profile strip 31 is pivotable or tiltable in directions K1 or K2 about an extension axis of the roll doctor 302. Arm 39 is so mounted in a printing apparatus, that the profile strip 31 can perform a tilting movement about the doctor roll 302. In particular, axis 320 in FIG. 1 can move about all the polar (radial) coordinate directions perpendicular to joint axis 320.

In FIG. 10 the receptacle web surface 315 is pressed along the longitudinally axially parallel engagement line 316 by the action of the magnetic device 6, combined with the magnetizable masses of the support member parts 35, 340 and their weight on the doctor roll 302, which is in turn pressed along its extension on screen 7. In the vicinity of the doctor roll vertical area the profile strip 31 tilts or pivots about the engagement line 316 which consequently is located in this area in the vertical region of the doctor roll 302.

In FIG. 11 there is a fixed spacing A between the joint axis or spindle 320 and the printing blanket 8, which makes it possible to tear away the doctor roll 302, accompanied by magnetic attraction by magnetic device 6, from the receptacle web surface 315 for pressing on screen 7 and as shown in FIG. 11.

In FIGS. 10 and 11 the doctor roll 302 sealingly engages on a longitudinally axially parallel engagement line 317 of one of the flank surfaces of receptacle 314. By suitable tilting and/or displacement of the joint spindle 320, the doctor roll 302 can also be engaged on the other receptacle flank surface.

It can be seen that the profile member 31 when the printing apparatus is not working, i.e. when the magnetic device 6 is not working, together with the roll doctor 302 mounted or carried in receptacle 314 through the permanent magnet 340 in the attracted state, can be handled as a unitary, one-part, quasi-integral component.

Figure 12:
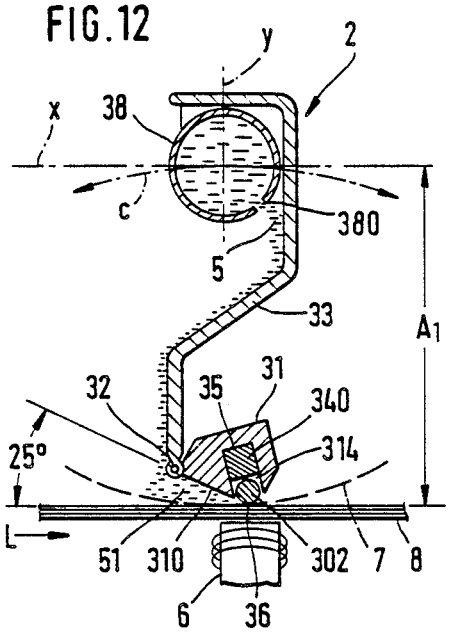
FIGS. 12 and 13 are plan views, partly in section, of a device according to the invention with a pivotably arranged mounting support in two operating positions.
Figure 13:
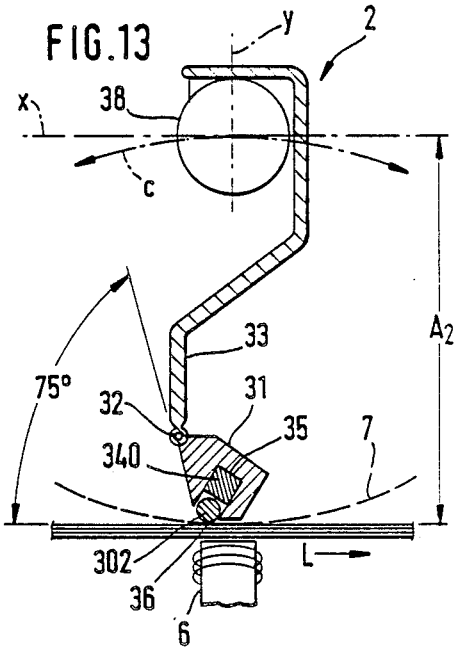

FIGS. 12 and 13 show a change to the angle between the application surface 4 and a planar profile surface 310 of profile member 31 from 25° to 75°. This angular change is achieved with a relatively small variation to the spacing between mount 2 and application surface 4, particularly e.g. with an increase from A1 to A2 of 10 mm. The raising and lowering of mount 2 or the retaining member 33 fixed thereto appropriately take place continuously and steplessly. The mount is raised from the position according to FIG. 12, along an axis Y, which is perpendicular to the application surface 4, into the position according to FIG. 13. The pressing line 36 of the roll doctor 302 is displaced counter to the running direction L of printing blanket 8 from the centre or symmetry plane of the magnetic device 6. Mount 2 can e.g. be arranged and guided in such a way that it is pivoted on a circular path C directed towards the application surface 4 in order to modify the spacing with respect to surface 4. Adjustment movements in directions Y and C can be combined. Obviously a guide for mount 2 can also be constructed in such a way that the latter is movable in direction Y and along an axis X parallel to application surface 4. In general, the mount 2 can be equipped with a guide, which ensures a change to the spacing with respect to the application surface and also permits a movement of mount 2 in desired further (coordinate) directions. As a result of the inventive measures, it is possible to use small diameter roll doctors 302, e.g. with a diameter of 5 mm, as well as even smaller diameters.

FIG. 12 shows in an exemplified manner the supply of the application material (substance) 5. A crossbeam 38 fixed to the retaining member 33 and which forms part of mount 2 is also constructed as a substance supply pipe. Through openings 380 arranged along the length of the supply pipe passes substance, which is guided along the retaining member 33 and passes into the substance accumulation area 51.

Figure 14:
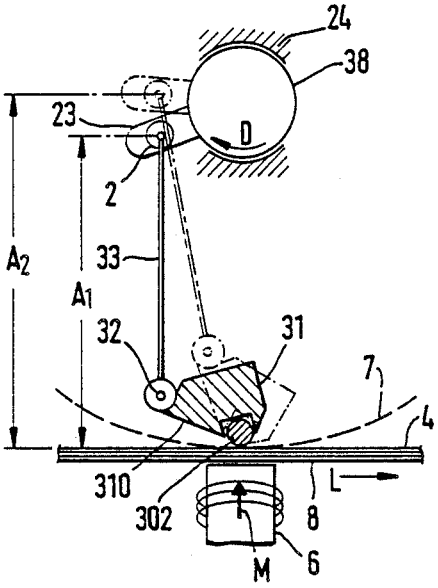
FIGS. 14 and 15 are plan views, partly in section, of devices according to the invention with fixed held doctor pressing lines and different pivoting arrangements for modifying the position of the mounts with respect to the bearing surface.
Figure 15:
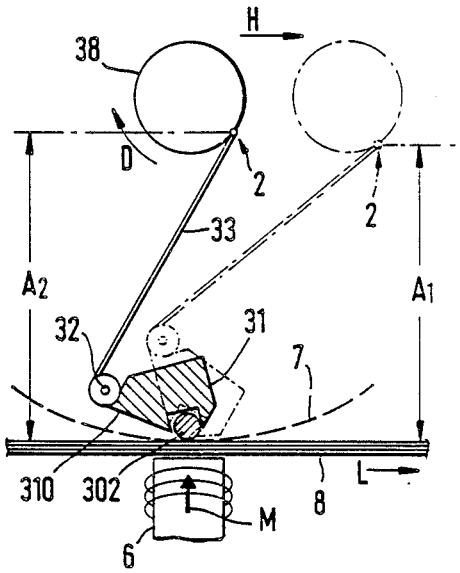

FIGS. 14 and 15 show means according to the invention with magnetizable roll doctors 302, which by magnetic pressing by means of a magnetic device 6 below the application surface 4 are held in a fixed position, which is therefore not positionally variable during the operating state of an application machine and is indicated by arrow M. In FIG. 14 the upper end of retaining member 33 is pivotably connected to an arm 23. This pivotal connection forms a mount 2. Arm 23 is connected in non-rotary manner with a rod or crossbeam 38, which is pivotably held in a bearing receptacle 24. In FIG. 15 the upper end of retaining member 33 is connected in non-rotary manner to the casing or surface of a rod or crossbeam 38, said fixture forming a mount 2. A not shown guide is formed, which mounts the crossbeam 38 so as to be pivotable and movable parallel to the application surface 4. If crossbeams 38 are rotated in direction D, the inclination angle of the profile surface 310 of profile members 31 becomes larger with respect to the application surface 4 and the broken line positions are reached. In the embodiment according to FIG. 15, there is also a displacement of the crossbeam 38 in direction H. As can be gathered from FIG. 15, there can be a significant change to the inclination angle as a result of a small spacing change (from A2 to A1), the distance between the crossbeam 38 and the application surface 4 being kept constant.

The embodiments of the invention according to FIGS. 16 to 19 will now be described.

A material web 4 passes over a magnet beam 6, which serves as a mating surface for a circular screen 7, in which there is a roll doctor 303, pressed by beam 6 against screen 7. A substance 5 is fed into the circular screen 7 by means of a feed pipe 38. Substance 5 passes via openings 380 in feed pipe 38 into an accumulation area 51 upstream of the roll doctor 303. To the feed pipe 38 is fixed a retaining member 33, which carries a profile strip 300 at its lower end.

Figure 16:
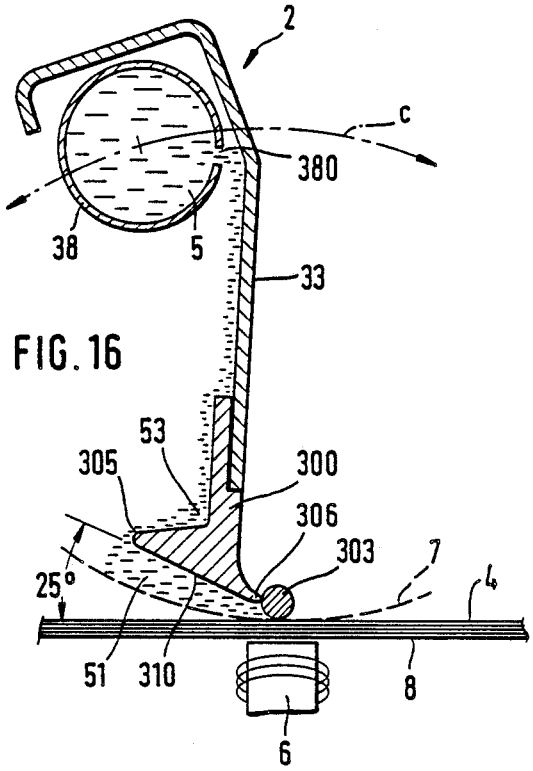
FIGS. 16 to 19 are plan views, partly in section, of devices according to the invention for modifying the angular position of doctor devices in different operating positions.
Figure 17:
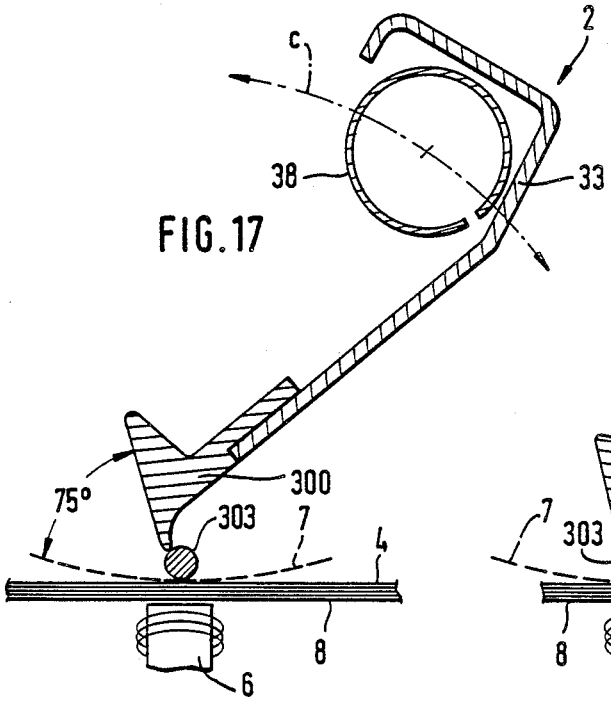

FIGS. 16 and 17 show means according to the invention into two working positions. One end of profile strip 300 is fixed to retaining member 33. The other end of profile strip 33 is fixed to the feed pipe 38, which forms a mount 2. The profile strip 300 is provided with cutting edge-like edges 305, 306 at right angles to the running direction L of material web 4. A leading edge 306 engages on roll doctor 303. The retaining member 33 is mounted in such a way that it can be pivoted about the roll doctor 303 as a pivot axis. Thus, the ink supply tube 38 can be continuously pivoted together with the profile strip 300. Edge 306 permanently engages on the roll doctor 303. Through a special construction of the profile strip 300 a collecting area 53 for the substance 5 to be applied is formed on the side remote from the material web 4. Substance 5 passes over edge 305 into accumulation area 51. FIG. 1 represents a working position where there is a maximum substance application, whereas FIG. 2 shows a working position with a minimum substance application.

Figure 18:
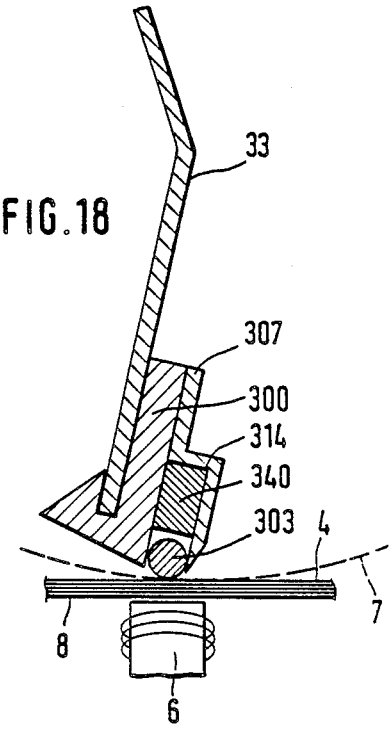
Figure 19:
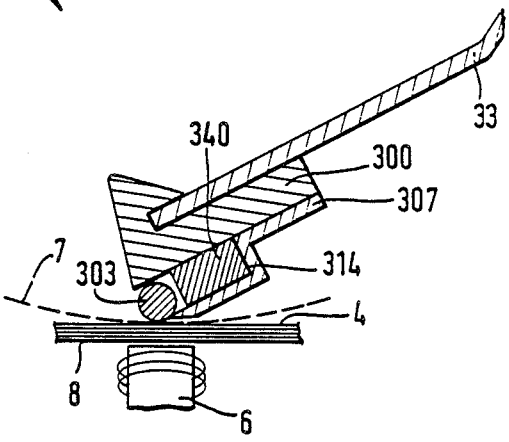

FIGS. 18 and 19 show a profile strip 300, to which is fixed an angle piece 307, which carries a holding magnet 340 and embraces at its lower end the roll doctor 303.

The profile strip 300 in the area of the roll doctor 303 facing substance 5 engages on said doctor. Engagement takes place in an area, which emanates from the contact line of the roll doctor 303 with screen 7 or material web 4 and covers an angle between 50° and 75°. However, an angular range of 25° is also acceptable. In the embodiments according to FIGS. 18 and 19 the roll doctor 303 is torn away from the retaining magnets 340 constructed as permanent magnets in the operating state, i.e. with the magnet beam 6 switched on. In the non-operative state, i.e. when magnet beam 6 is switched off, the roll doctor 303 jumps into another position. It is raised on the holding magnets 340 and is spaced from screen 7. Thus, the retaining member 33 or the feed pipe 38 fixed thereto and the profile strip 300 are pivotably mounted relative to the roll doctor 303. However, it is simultaneously achieved that the spacing between the holding member 33 and the roll doctor 303 is always the same in the operating state, i.e. there is a quasi-fixed position of doctor 303 in the machine.

As a result of the measures according to the invention, it is possible to use small diameter roll doctors 303, e.g. with a diameter of 5 mm, or even smaller.

Figure 20:
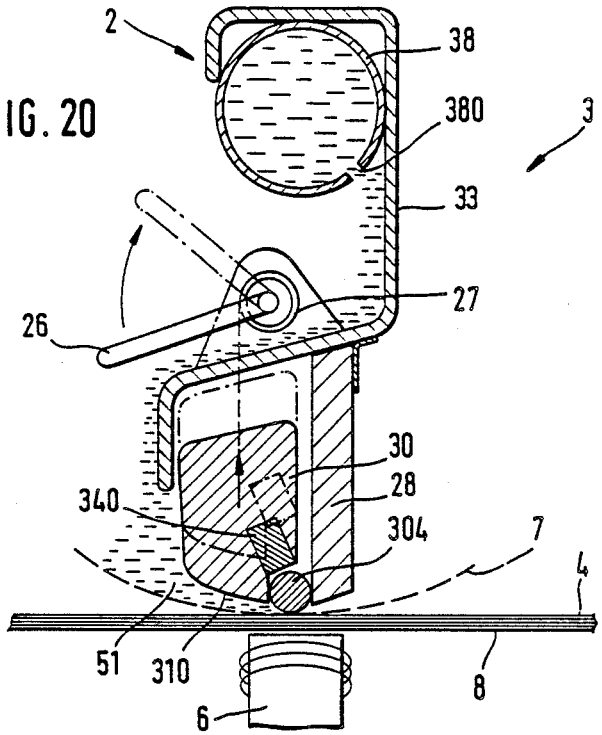
FIG. 20 is a plan view, partly in section, of a device according to the invention with a transverse mounting support of a profile member between the retaining member and the application surface.
Figure 21:
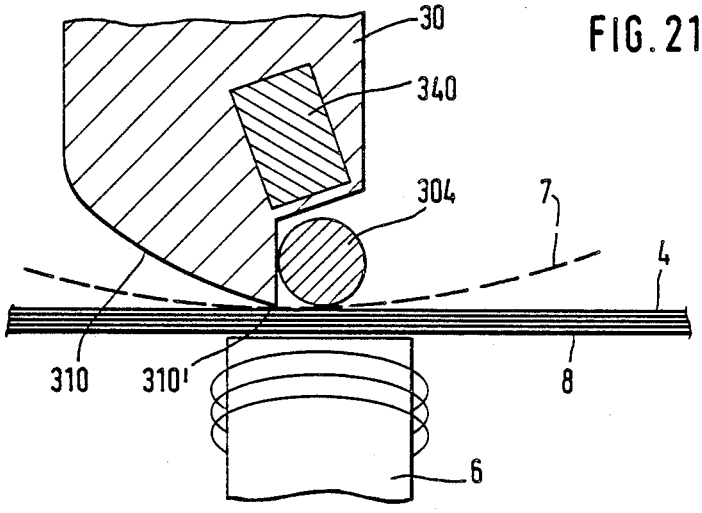
FIG. 21 is a partial view of the profile member according to FIG. 20.

Another embodiment of the invention would be described relative to FIGS. 20 and 21.

The fixture of a retaining member 33 to a feed pipe 38 forming a mount 2, as well as measures for supplying a substance are as in the embodiments according to FIGS. 16 to 19. In addition, the parts of a printing machine are arranged and provided as described hereinbefore.

In FIG. 20 a profile strip 30 is constructed in beam-like manner and can be raised and lowered relative to a material web 4. As can be gathered from FIG. 20, there is a continuous raising and lowering by means of a lever 26 and a cable pulley 27. It is also possible to provide pneumatic means for the raising and lowering of the profile strip 30. For the case that the profile strip 30 is to be raised with a profile surface 310 facing material web 4 over a roll doctor 304, it is appropriate to provide a sealing strip 28 behind the doctor 304. This prevents the material 5 to be applied flowing away over the roll doctor 304. The sealing strip 28 is fixed to the retaining member 33 or arranged thereon.

If desired, the profile strip 30 can be wholly or partly made from magnetizable material. A magnet beam 6 then not only attracts the magnetizable roll doctor 304, but also the profile strip 30, which prevents an undesired floating of the latter.

It is particularly important that the retaining member 33 of this embodiment is fixed and only the profile strip 30 is movable. FIG. 20 shows the lower and upper position (the latter in broken line form). In the operating state of a printing machine the roll doctor 304, even in the lower position of the beam-like profile strip 30, does not engage on the top of the latter.

According to FIG. 21 the profile surface 310 of profile strip 30 facing the substance 5 is somewhat lower than in FIG. 20, so that profile strip 30 rests with a bearing edge 310′ on screen 5, which leads to an additional scraping action. The profile surface 310 defines the accumulation area 51 and the latter can be increased or decreased in size by modifying the position of profile member 30.

It is particularly advantageous that as a result of the fixed arrangement of the retaining member 33 in the machine operating state the roll doctor 301 can be torn away from permanent magnetic holding magnets 340 attracting the same in the operating state. Thus, an air gap is formed between the doctor roll 304 and the holding magnet 340, as shown in FIGS. 20 and 21. When the magnet beam 340 having the holding magnets is ineffective, the roll doctor 304 jumps into an engagement position against magnets 340. Thus, a very practical integral handling unit comprising profile strip 30, holding magnets 340 and roll doctor 304 is obtained.

It is possible to use a small diameter roll doctor 340, e.g. 5 mm, as well as one having a smaller diameter.

The invention is not restricted to the arrangement shown in the drawings with a horizontal application surface 4. As a result of the magnetic pressing of a doctor, as a function of the desired use, the profile member can be arranged and oriented with respect to a vertically positioned application surface or an application surface inclined under a random angle. The application surface can be curved.

I claim:

1. An apparatus for applying substances having differing viscosities to an application surface, comprising:
   an angularly adjustable doctor device and means for variably positioning the doctor device including a mount;
   said doctor device including a profile member having a first longitudinal axis, a doctor having a doctor pressing line guided by said profile member; and
   a retaining member having opposite ends wherein one end of the retaining member is supported by the mount and the other end of the retaining member is pivotally connected to the profile member by a joint having a second longitudinal axis such that the pivoting of the profile member about the joint is caused by a change in a spacing of the mount with respect to the application surface.

2. The application apparatus according to claim 1, wherein said profile member has at least one longitudinally axially parallel profile surface facing the application surface to form an application material area including a working gap tapering in a wedge-shape manner toward the doctor pressing line.

3. The application apparatus according to claim 1, further comprising said doctor being a one blade coating doctor and said profile member being of unitary construction, said coating doctor having a side facing the application surface and being inserted into the profile member so that a profile surface part of said profile strip covers said side facing the application surface of said coating doctor so that said coating doctor is only free in the vicinity of its blade.

4. The application apparatus according to claim 1, wherein said profile member is constructed at least in part from a magnetizable material.

5. The application apparatus according to claim 1, wherein said means for variably positioning said doctor device includes means for vertically adjusting the mount with respect to the application surface.

6. The application apparatus according to claim 1, wherein said mount is pivotable about an axis parallel to said first longitudinal axis of said profile member.

7. The application apparatus according to claim 1, wherein said means for variably positioning said doctor device includes means for moving said mount in a plane parallel to the application surface, said mount being perpendicular to a longitudinal extension of the profile member.

8. The application apparatus according to claim 1, wherein said mount has mounting supports for carrying the retaining member and said means for variably positioning the doctor device includes means for moving the mount laterally of the application surface and also vertically with respect to the application surface.

9. The application apparatus according to claim 1, further including said profile member having at least two joint couplings such that said profile member can be pivoted to the left or to the right with one or the other of the couplings.

10. The application apparatus according to claim 1, further including said mount having a cross beam and said retaining member being fixed to said cross beam.

11. The application apparatus according to claim 1, wherein said retaining member is connected to said mount to project downwardly at an angle so that the pressing line of the doctor is located in an area under the mount during positional variations of the mount.

12. An application apparatus according to claim 1, wherein said joint includes said profile member having at least one connecting element in the form of a plug so that said profile member can be rapidly detached from said retaining member.

13. The application apparatus according to claim 1, wherein said joint is a material-elastic hinge.

14. The application apparatus according to claim 1, wherein said joint and said variably positioning means prevents relative movement of said doctor pressing line with respect to said application surface during movement of the mount.

15. The application apparatus according to claim 1, wherein said roll doctor has an upper area along its circular profile for engaging a top wall of the receptacle opposite the application area to form a pivot axis of he profile member.

16. The application apparatus according to claim 1, wherein said profile member has a unitary construction and said doctor is a blade doctor inserted in said profile member further comprising said doctor being a one blade coating doctor and said profile member being of unitary construction, said coating doctor having a side facing the application surface and being inserted into the profile member so that a profile surface part of said profile strip covers said side facing the application surface of said coating doctor so that said coating doctor is only free in the vicinity of its blade.

17. The application apparatus according to claim 16, further comprising said profile member having a recess remote from the application surface and on the side of the coating doctor, said recess allowing the blade of the coating doctor to flex in the direction away from the application surface.

18. The application apparatus according to claim 1, wherein said doctor is a roll doctor and said profile member is a profile strip having a receptacle with a rectangular cross-section for receiving and guiding said roll doctor.

19. The application apparatus according to claim 18, wherein said receptacle has walls with a spacing therebetween in relation to a diameter of the roll doctor that permits the roll doctor to be movably held in the receptacle perpendicularly to a longitudinal direction of said roll doctor.

20. The application apparatus according to claim 1, further comprising said doctor being a roll doctor and said profile member having a permanent magnet device extending parallel to said first longitudinal axis, and said profile member having a receptacle adjacent said permanent magnet device for receiving and guiding said roll doctor whereby said roll doctor is magnetizable and the force of the permanent magnet holds the roll doctor in the receptacle to permit free running movement of the roll doctor against at least one wall of the receptacle.

21. The application apparatus according to claim 20, wherein said permanent magnet device has a support member having a non-magnetizable sliding surface forming a wall of said receptacle facing said application surface.

22. The application apparatus according to claim 1, wherein said profile member has a support member extending parallel to said first longitudinal axis for pressing said doctor.

23. The application apparatus according to claim 22, further comprising a magnetic device arranged below the application surface opposite to said doctor and said support member being constructed of a magnetizable material so that the doctor is magnetically attracted to said magnetic device and pressed onto the application surface.

24. An apparatus for applying materials of different viscosities to an application surface using a doctor device, comprising:

said doctor device having a magnetically pressable roll doctor having a circular profile and a pressing line contacting the application surface, and a profile member having at least one profile surface facing the application surface and extending parallel to a longitudinal axis of the roll doctor;

means for moving the doctor device including a retaining member in the form of a retaining strip having opposite ends and a mount movable with respect to the application surface, wherein said retaining strip is mounted at one end to the mount and mounted pivotably at its other end to the profile member by a joint such that the profile member is spaced by the retaining member from the mount; and said profile member having an accumulation area for the application material upstream of the roll doctor whereby varying the height of the profile member with the moving means varies the area of said accumulation area.

25. The application apparatus according to claim 24, wherein said profile member has a beam-like construction that can be raised and lowered vertically with respect to the application surface with said moving means.

26. The application apparatus according to claim 24, wherein said doctor device includes a sealing strip disposed opposite to the accumulation area behind the roll doctor and extending parallel thereto.

27. The application apparatus according to claim 24, wherein said profile member further includes holding magnets for holding the roll doctor.

28. The application apparatus according to claim 24, wherein said profile member is at least partly made from magnetizable material.

29. An applicator for applying material of different viscosities with a doctor device, comprising:

a magnetically pressable doctor and magnetic means for pressing the doctor against a substrate;

an profile member provided with a pivot joint and means for holding and guiding said doctor wherein said profile member has at least one profile surface parallel to a longitudinal axis of one of the at least one said doctor.

30. A doctor device according to claim 29, wherein said profile member has a recess on a side of the coating doctor removed from the application surface for allowing the doctor blade to move in a direction away from the application surface.

31. A doctor device according to claim 29, wherein said doctor is a blade coating doctor that is inserted into said profile member.

32. A doctor device according to claim 31, wherein said blade coating doctor has a side facing the application surface that is covered by a profile surface part so that only an area of the blade adjacent the application surface is exposed and extends freely.

33. The doctor device according to claim 29, wherein said profile member has a receptacle and said doctor is a roll doctor that is received and guided within said receptacle, said receptacle having a rectangular cross-section.

34. The doctor device according to claim 33, wherein said receptacle has walls and an internal spacing between adjacent walls such that the roll doctor is movably held in the receptacle perpendicularly to its extension.

35. The doctor device according to claim 29, wherein said doctor is a roll doctor and said profile member has a permanent magnet device extending parallel to the longitudinal axis of the profile member, said profile member having a receptacle adjacent said permanent magnet device and having interior sliding surface walls, and said roll doctor being magnetizable such that said roll doctor is held and guided for free rotation by the force of the permanent magnet device against the sliding surface walls of the receptacle.

36. The doctor device according to claim 35, wherein said profile member has a support member extending parallel to the longitudinal axis of the profile member and forming a wall of the receptacle for pressing the roll doctor blade against the application surface.

* * * * *